US005673837A

United States Patent [19]

Meschi

[11] Patent Number: 5,673,837

[45] Date of Patent: *Oct. 7, 1997

[54] APPARATUS FOR THE HIGH SPEED STACKING OF PAPER SHEETS

[75] Inventor: Luciano Meschi, Castiglioncello, Italy

[73] Assignee: Industria Grafica Meschi SRL, Livorno, Italy

[ * ] Notice: The portion of the term of this patent subsequent to Oct. 3, 2011, has been disclaimed.

[21] Appl. No.: 90,017

[22] PCT Filed: Nov. 18, 1992

[86] PCT No.: PCT/EP92/02650

§ 371 Date: Sep. 14, 1993

§ 102(e) Date: Sep. 14, 1993

[87] PCT Pub. No.: WO93/10032

PCT Pub. Date: May 27, 1993

[30] Foreign Application Priority Data

Nov. 18, 1991 [IT] Italy ..... MI91A03074

[51] Int. Cl.[6] ..... B26F 3/02; B65H 35/10

[52] U.S. Cl. ..... 225/100; 225/105

[58] Field of Search ..... 225/100, 101, 225/104, 105

[56] References Cited

U.S. PATENT DOCUMENTS

| | | | |
|---|---|---|---|
| 2,902,197 | 9/1959 | Potdevin et al. | 225/105 |
| 3,794,228 | 2/1974 | Colwill et al. | 225/101 X |
| 4,529,114 | 7/1985 | Casper et al. | 225/100 |
| 4,577,789 | 3/1986 | Hofmann et al. | 225/100 |
| 5,230,453 | 7/1993 | Meschi | 225/100 |

FOREIGN PATENT DOCUMENTS 2 144 991 3/1973 Germany .

*Primary Examiner*—Rinaldi I. Rada
*Assistant Examiner*—Raymond D. Woods
*Attorney, Agent, or Firm*—McAulay Fisher Nissen Goldberg & Kiel, LLP

[57] ABSTRACT

Apparatus for high speed stacking and cutting of resilient materials to form individual sheets wherein the resilient material is moved through the apparatus towards a stacking plane and is guided past a tear separator actuatable to effect a tear separation along a transverse prepunched line. The tear separator comprises two pairs of respectively upper and lower rollers for friction contact with the sheets. One roller of the upper rollers is provided with a planar beveled portion and the lower rollers are essentially cylindrical, and at least one of the lower rollers is driven into rotation with a speed higher than that of the upper rollers. The lower rollers are spaced from each other in a rest condition when the beveled portion is parallely positioned in front of a plane of the connected sheets in the rest condition of the upper rollers. The lower rollers are brought into frictional contact with the sheets in an operating condition of the lower rollers, and the upper rollers are driven into rotation and brought into friction contact with one of the sheets when one of the transverse prepunched lines is between the upper and lower rollers. A presser is positionable in a rest position spaced from the sheets when the upper and lower rollers are in the rest conditions and the presser is brought to an operating position when the upper and lower rollers are brought into engagement with the sheets during the tearing phase.

19 Claims, 9 Drawing Sheets

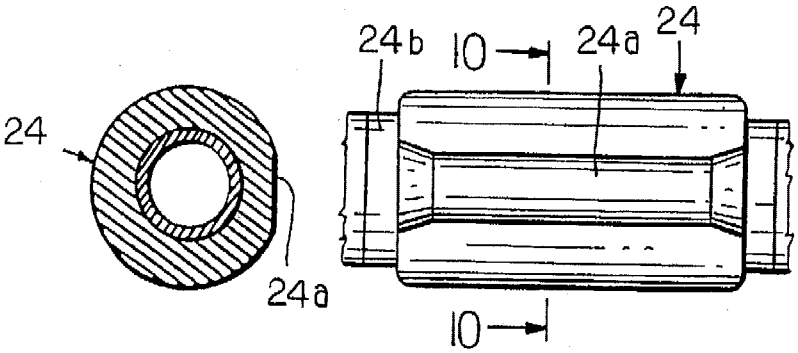
FIG. 10
FIG. 11
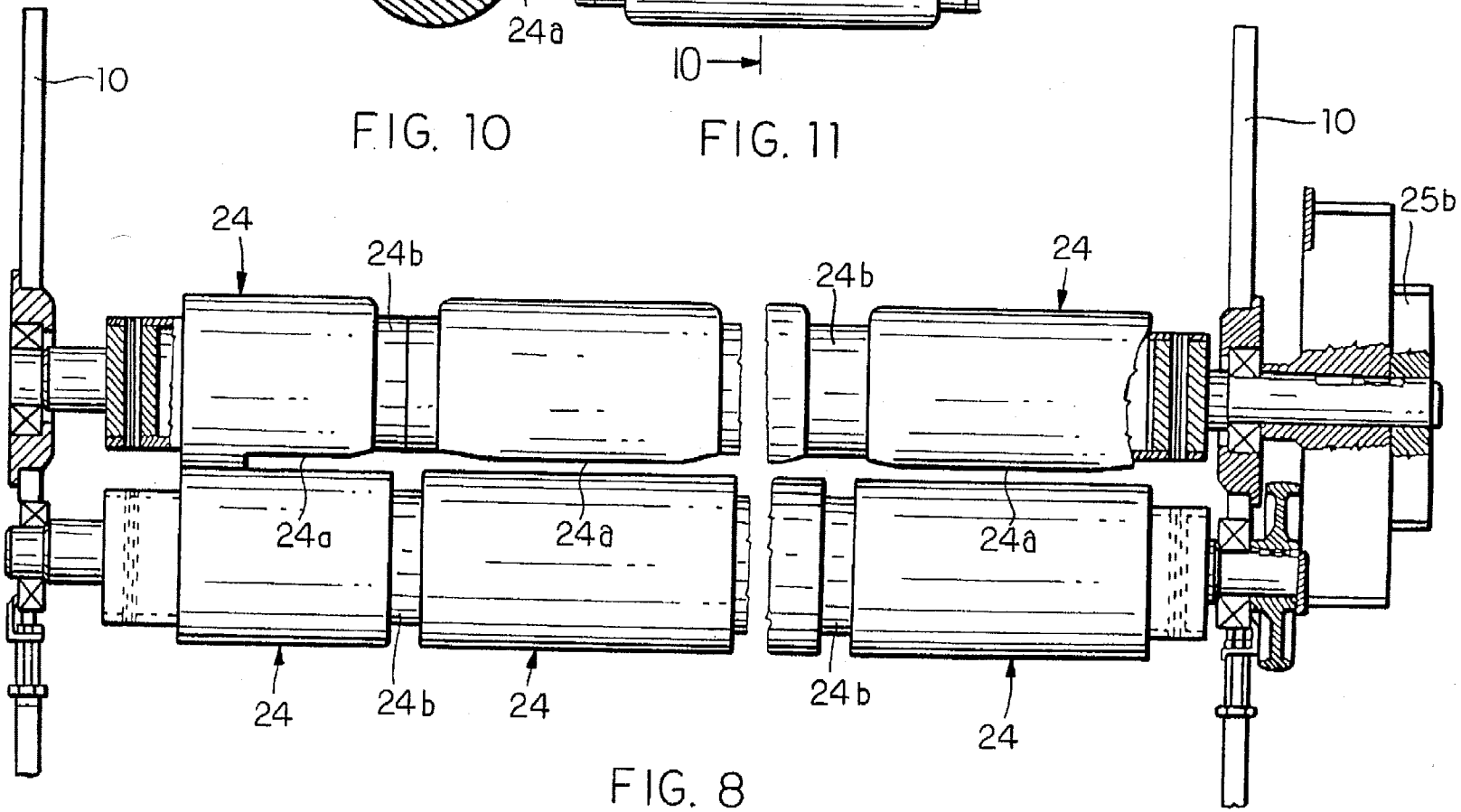
FIG. 8

APPARATUS FOR THE HIGH SPEED STACKING OF PAPER SHEETS

BACKGROUND OF THE INVENTION

1. Field of the Invention

The present invention relates to an apparatus for high speed stacking of paper sheets or forms. Such a stacking is effected by an apparatus according to the invention both by an accordion-like folding of a continuous band along portions thereof at predetermined spacings and, alternatively, by simply superimposing separate sheets.

Such an apparatus finds particular application both in the preparation of paper for high speed printers, such as laser printers and the like, in the form of a folded continuous band folded in an accordion-like manner to form packages containing a predetermined number of loops or "forms" connected to each other by prepunched cross lines, and in the superimposition, still accordion-like, of said forms coming out of the printer or by simple superimposition thereof after their separation by a tearing action along the aforesaid prepunched lines of the band.

2. Description of the Prior Art

Apparatus are already known by which the problem of the high speed stacking of paper sheets or forms, such as for example those being the subject of the European Patent Application EP-A-368,392, and of EP-A-412,437, in the name of the same Applicant, to which reference shall be made in the description of the apparatus of the present invention.

It has been observed that the apparatus according to the above European applications, although being fully reliable to carry out their duty, sometimes raised operating difficulties with specific reference to the tearing separation of the band both for the carrying out of the separation per se, and for the reason that such a separation produces strains of not negligible value which may induce negative effects on the devices positioned at the inlet of the apparatus for the control of the band advancement in the apparatus. It has been furthermore seen that the flexibility of these apparatus was limited by the fact that they were difficult to use for the stacking of single forms, namely of the forms coming out of the printer as a continuous band and separated from each other for example by tearing.

The stacking of forms separated from each other is not a simple operation mainly because, contrarily to the case of the continuous band for which no particular problems exist in order to "direct" portions thereof towards stopping and/or folding stations for the edges of said portions since the band is a continuous assembly, these problems exist and are important in the case of separate forms both in terms of their guidance and of their proper orientation.

It has been also found that the aforesaid apparatus, as a consequence of the number of operating parts of which they are composed, were of rather cumbersome construction also owing to the necessity of providing more than one control motor for their operation. Moreover the presence of more than one control motor causes the probabilities of an intervening request for the machine maintenance to be increased. The purpose of the present invention is that of providing an apparatus by which the above mentioned problems are solved in an advantageous, very simple and reliable manner.

SUMMARY OF THE INVENTION

A more specific even if non exclusive purpose of the present invention is that of providing a device for the tearing of the individual sheets for the separation thereof so that the sheets are useful in an apparatus of the above-mentioned type.

A further purpose of the present invention is that of providing an apparatus of extremely simplified construction and of particularly reduced size for the high speed stacking of sheets or forms both by means of an accordion-like folding of a continuous band and by superimposing separate sheets one on top of the other, which is fed with a continuous band and comprises dragging means therefor towards diverting or deviating means of its portions suitably spaced or of the initial edge of said sheets towards either a first or a second stopping and/or folding stations positioned at two opposite sides of a sheet stacking plane, band guide means being provided between the band inlet area to the apparatus and said deviating means, said guide means being associated to means actuatable for carrying out the tearing separation of said band along a prepunched cross line thereof, comprising two pairs of respectively upper and lower rollers adapted to get into friction contact with the band, the aforesaid deviating means comprising nozzle means connected to an air pressure source, said nozzle means being suitable for emitting an air blow essentially orthogonally directed with respect to the plane of the paper sheet coming out from the said guide means and downstream of said tearing separation means, said apparatus being characterized in that either roller of the pair of upper rollers is provided with at least a planar bevelled portion and by the fact that the lower rollers are essentially cylindrical, at least one of them being permanently driven into rotation with a peripheral speed higher than that of the upper rollers, said lower rollers being spaced from each other in the rest condition when said bevelled portion of the upper roller is parallely positioned in front of the plane of the paper band in the rest condition of the aforesaid roller and being brought into friction contact with the band in the operating condition, between said upper and lower roller pressing means being positioned which are displaced from a retired or rest position in which they are detached from the said band when the upper and lower rollers are in the rest condition to an operating position in which they are engaged therewith during its tearing phase, said sheet-stacking plane being provided with ejecting means for the sheet packages and with sensing means detecting their presence onto said plane.

BRIEF DESCRIPTION OF THE DRAWINGS

The features and advantages of the apparatus according to the present invention shall appear more clearly from the following detailed description of a non limiting embodiment thereof, the description being made with reference to the accompanying figures in which:

FIG. 8 is a schematic plan view of the upper rollers of the tearing separation device;

FIG. 10 is a cross section view of one of the upper rollers;

FIG. 11 is a partial view from above of one of the upper rollers;

FIG. 14 is a perspective view of a first embodiment of the invention, disclosed in European Patent Application Number 92100830.7 which is referred to subsequently in the description, concerned with a device for aligning a continuous folded strip, stored in a stacker according to the invention disclosed in the aforenoted European Patent Application 91200830.7; and FIG. 15 is a partially perspective view of a second embodiment of the same device in the aforesaid European Patent Application No. 92100830.7 for aligning a continuous strip of folded sheets.

DESCRIPTION OF THE PREFERRED EMBODIMENTS

Figure 1:
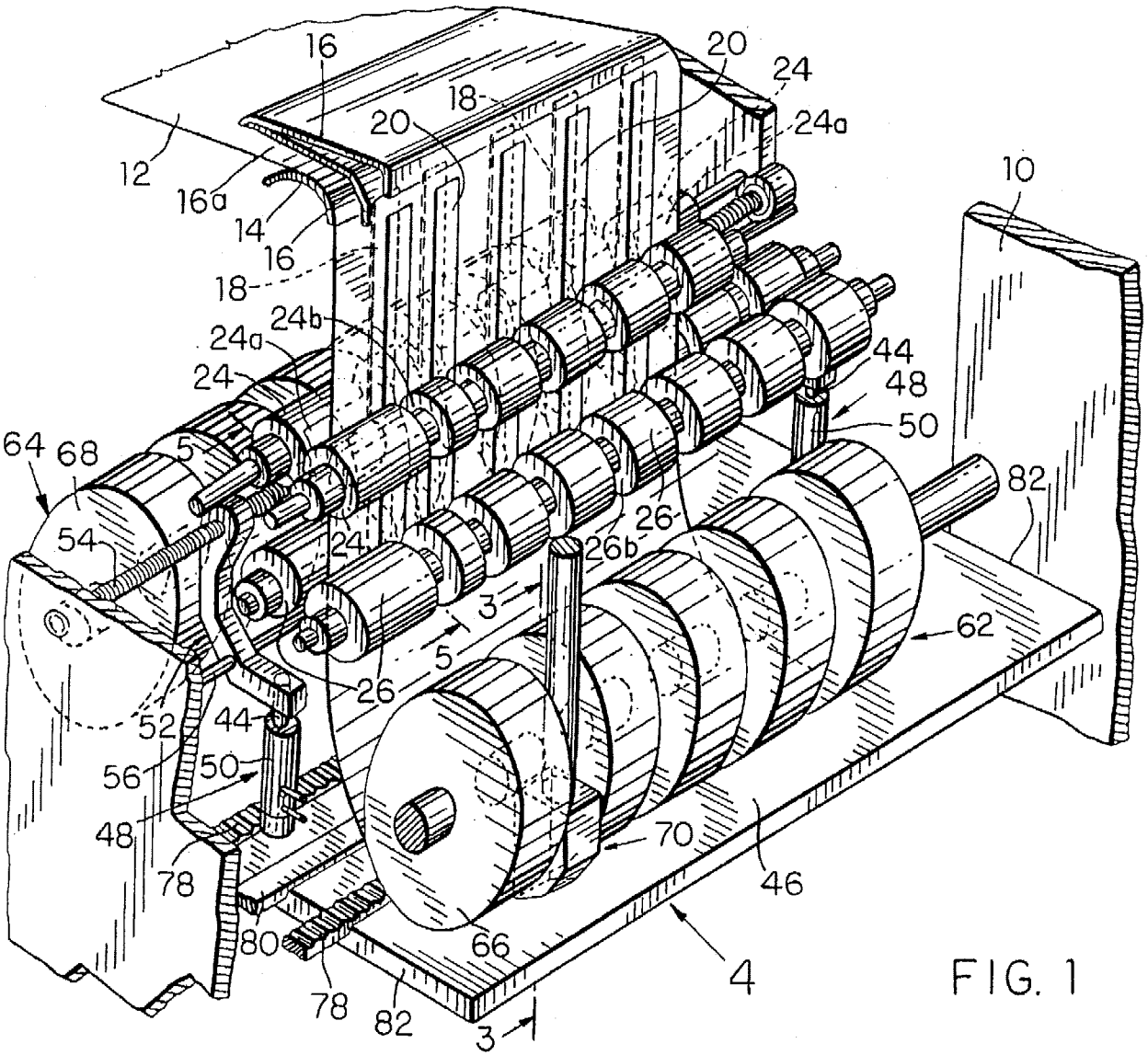
FIG. 1 is a schematic perspective view, with portions partially omitted, of the apparatus according to the invention as a whole.
Figure 2:
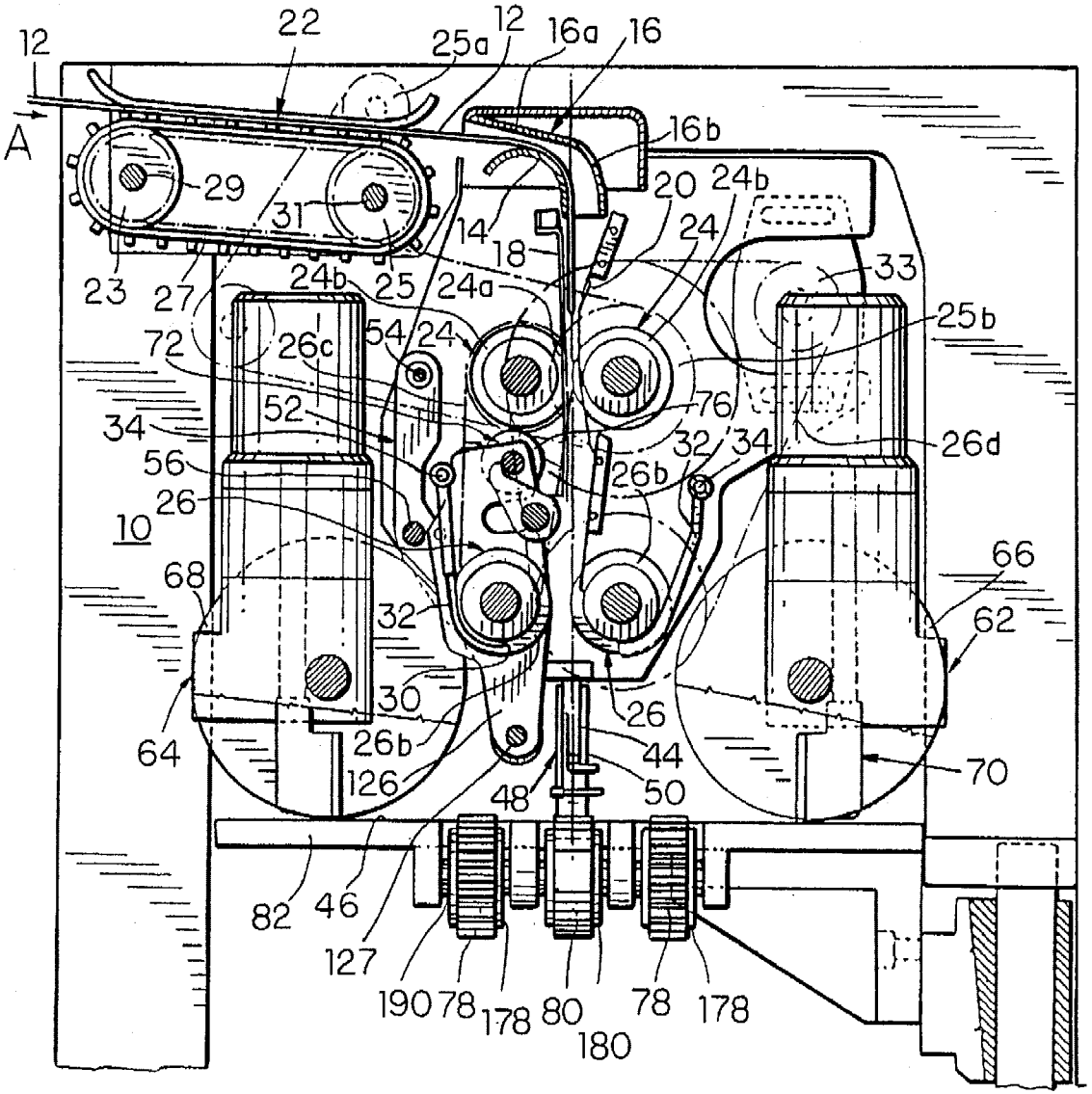
FIGS. 2 and 2*a* are schematic side elevation views of the apparatus of FIG. 1 in two operating conditions.

With particular reference to FIGS. 1 and 2, apparatus according to the present invention comprises a fixed framework 10 onto which the means for the stacking of paper sheets are placed. These sheets are either in a form of a continuous band or are separated from each other.

In the present disclosure, only by way of example, reference shall be made to and an explanation of the case of the stacking of separate sheets since the same considerations hold true both for the stacking of sheets in form of a continuous band as well as individual sheets.

It is anyhow to be noticed that the paper sheets are fed to the apparatus at an inlet thereof in both cases with a continuous paper band 12 having perforations at the side edges thereof. It arrives according to the direction of the arrow A of FIG. 2 for instance from a printer not shown. At the inlet of the apparatus there are provided dragging means for the band 12 consisting, in the embodiment under consideration, of a pair of known "tractors 22", one for each perforated side edge of the band 12. Only one of them is viewable and represented in FIG. 2, the other being identical. Both tractors comprise a pair of gears 23, 25, connected to each other by a toothed belt 27 and secured by keying to shafts 29, 31, rotatably supported by the framework 10. One of the gears 23 is connected, by means of a ratchet device (not shown) provided at the end of the shaft 31 associated to the same gear 25 and of a transmission gearing comprising toothed belts and toothed pulleys 25*a*, 25*b*, coupled with a single control motor of the apparatus, indicated by the reference 33. The advancement of the tractors 22 is thus unidirectional. At the end of the shaft 31 opposite to that bearing the above mentioned ratchet device, a sensing device is provided for detecting the angular position of said shaft 29, such as an "encoder" or the like (not shown), thus adapted to provide a signal corresponding to the position of the shaft 31 and thus of the band 12 and particularly of the prepunched lines thereof. This information is very useful for the sequence activation of the several operating parts of the apparatus. Still at the inlet of the apparatus two guide profiles 14 and 16 (FIG. 2) are provided and fastened in a known manner to the framework 10, which guide profiles 14,16, guide the band 12 and deviate the band 12 downwardly thus advancing the band according to an essentially vertical direction. The length of both profiles 14 and 16 is equal to the maximum width possible for the band 12 feeding the apparatus.

More particularly the lower profile 14 has a half circle or semi-circular shape, whereas the upper one, profile 16 has a first essentially planar length 16*a* which is downwardly inclined and is extended by a second length 16*b* having the shape of an arc of a circle.

Below the profiles 14,16 a first and a second plurality of essentially rectilinear guide strips 18, 20, are connected in a known manner (not shown) to the framework 10. The strips are positioned opposite to each other and are parallel to each other in pairs and are spaced from each other, and the spacing between the strips of one series and those of another series as well as the spacing between the strips of each adjacent series and lastly their width are predetermined as hereinafter clarified.

The upper end of each rod 18, 20 is outwardly bent so as to form a substantially funnel-like structure forming an invitation or entry for introduction of the band 12 between said strips.

The strips 18, 20 are associated with means for carrying out the tearing of the band 12 along prepunched cross lines thereof and these means are actuated or not depending on whether the apparatus operates with separate forms or as a continuous band.

These means shall be described hereinafter with reference to the FIGS. 5 to 11.

As above stated the strips 18, 20 are of a predetermined width and are suitably spaced. In this manner the strips can be positioned so that they pass through grooved pads 24*b*, 26*b* of the rollers 24, 26 forming the means for the sheet tearing separation means, hereinafter described, thus being very close to each other and thus being a valid guide especially in the case of the processing of separate forms which might be displaced from the correct advancing direction just owing to the effect of the means foreseen for directing their foreedge towards one of the stopping stations, these means applying thereon a displacing action cross-wise directed with respect to the advancing direction.

The aforesaid means for the tearing separation of the forms comprise one pair of upper grooved rollers 24 and one pair of lower grooved rollers 26. The upper rollers 24 are essentially parallel to each other and one of the upper grooved rollers 24 in addition to groove 24*b* has a planar bevelled portion 24*a* (FIGS. 8, 10 and 11) so that the one grooved roller 24 does not have a complete outer circular circumference. In this manner, when said rollers 24 are positioned with the bevelled portion 24*a* in parallel with and facing the plane of the band 12, a passage is defined for the band which remains free for a short time, anyhow sufficient to permit possible strains to be relieved and possible undulations to be eliminated.

These strains and undulations, as a matter of fact, occur rather often in a band coming out from a printer, particularly a laser printer. The lower rollers 26, although essentially parallel to each other, are arranged so as to have two different positions with respect to each other respectively. In a resting position of rollers 26 they are spaced from each other, and in the operative position of the rollers 26, they are brought into frictional contact with the band 12 to carry out the tearing separation of one form.

Figure 7:
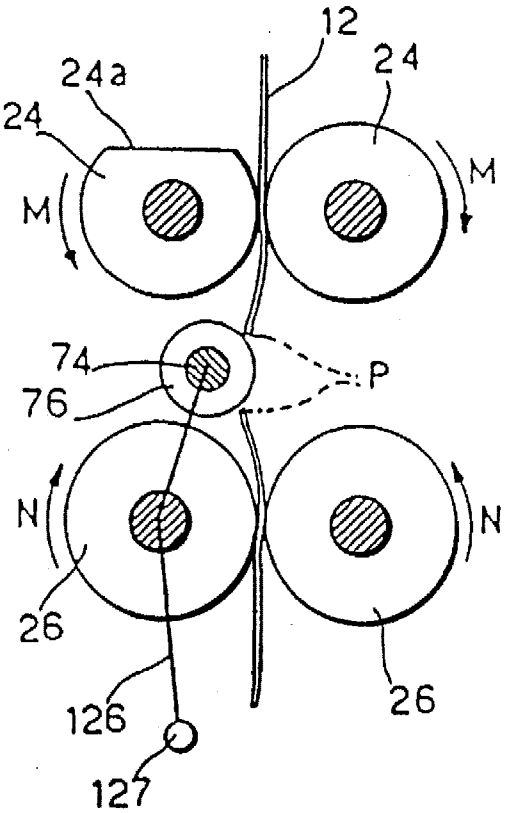
FIG. 7 is a view like FIG. 5 still according to the lines V—V of FIG. 5 showing the tearing phase.
Figure 6:
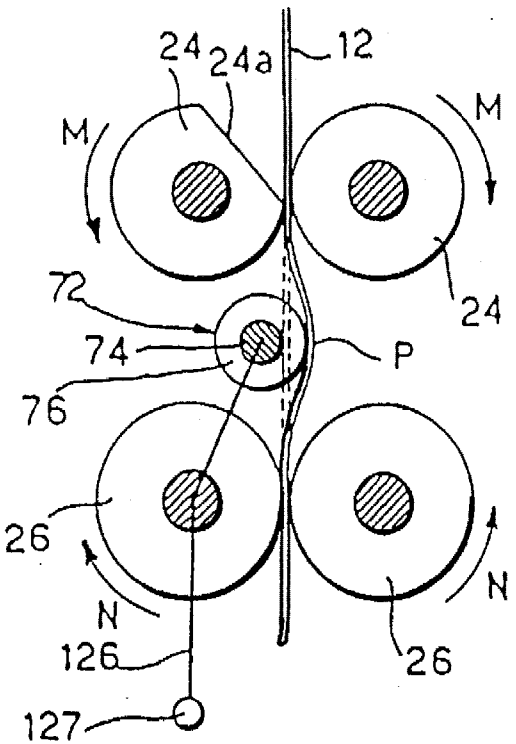
FIG. 6. is a representation like FIG. 5 of the device according to the lines V—V of FIG. 1 at the beginning of the sheet tensioning.
Figure 5:
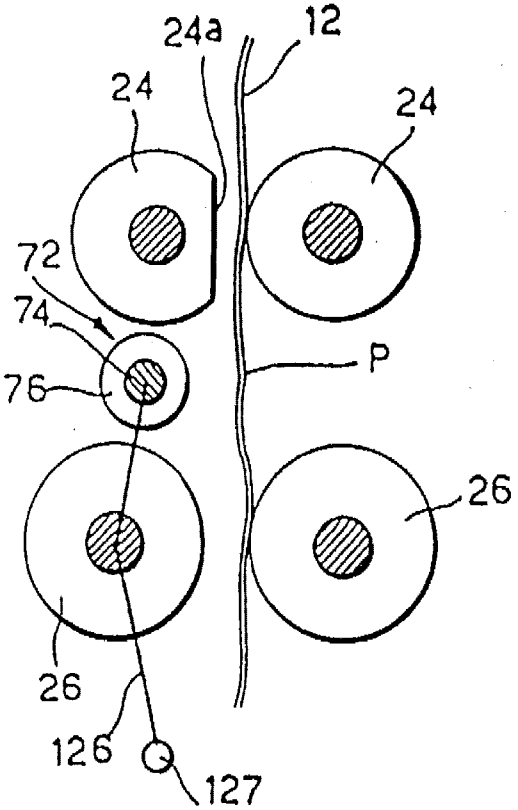
FIG. 5 is a very simplified representation of the tearing separation device, taken alone, according to the lines V—V of FIG. 1 in the rest condition.
Figure 9:
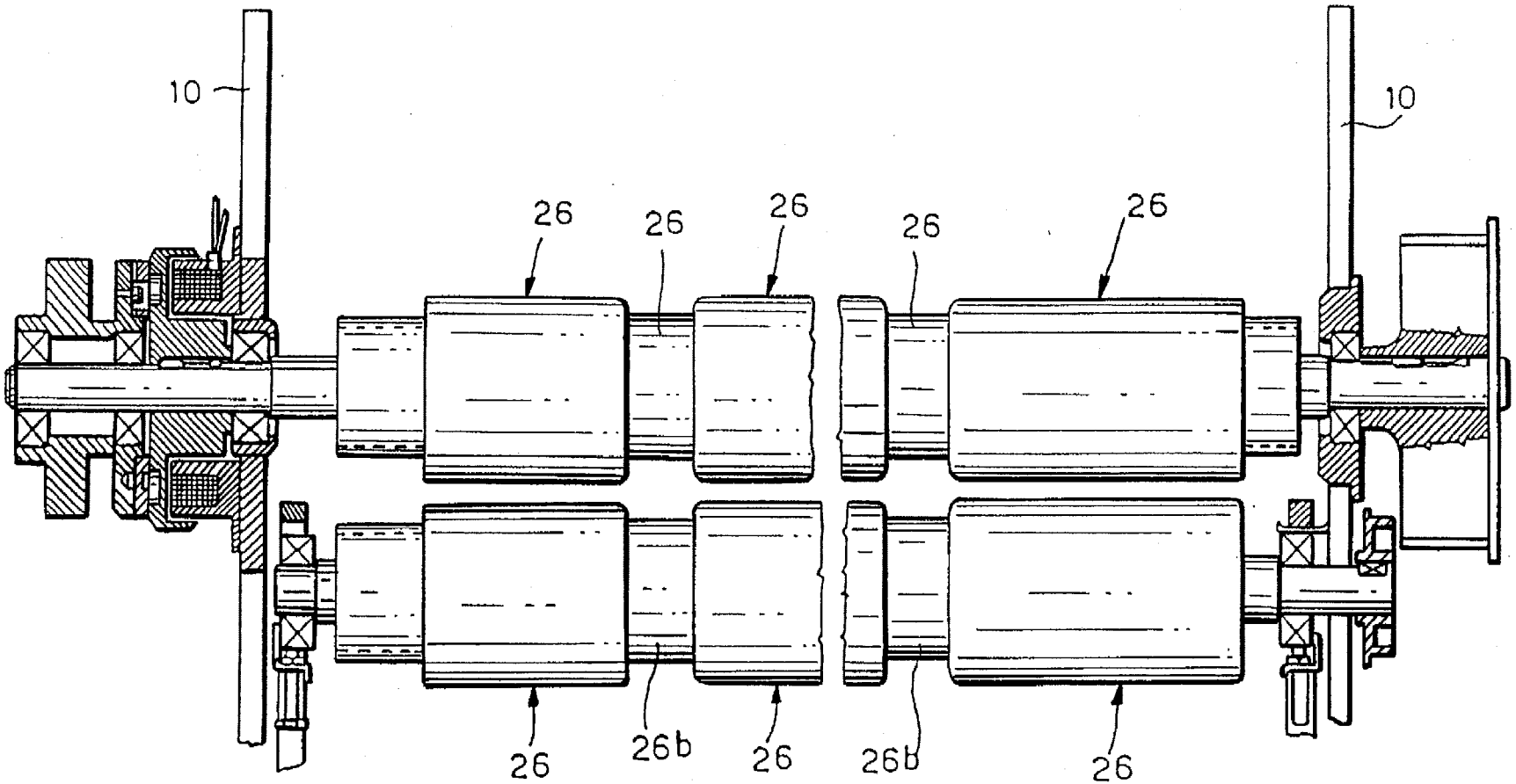
FIG. 9 is a schematic plan view of the lower rollers of the tearing separation device.

At least one of the two rollers 26, particularly the right side of the drawing looking at the FIGS. 1 and 2 as well as FIGS. 5 to 7, is permanently driven into rotation, and to this end it is connected to the control motor 33 through a known kinematic transmission, partially viewable in FIG. 2, for example comprising toothed pulleys and chains 26*c*, 26*d*. The roller 26 at the right side of the drawing is supported in a known manner by the framework 10 of the apparatus and is driven only in rotation whereby it cannot be displaced.

The second roller 26, particularly that of the left side of the drawing in FIGS. 1 and 2 and in FIGS. 5 to 7, is supported at the ends in a freely rotatable manner by a pair of shaped arms 126 pivotally connected at 127 to the framework 10 of the apparatus.

Figure 2A:
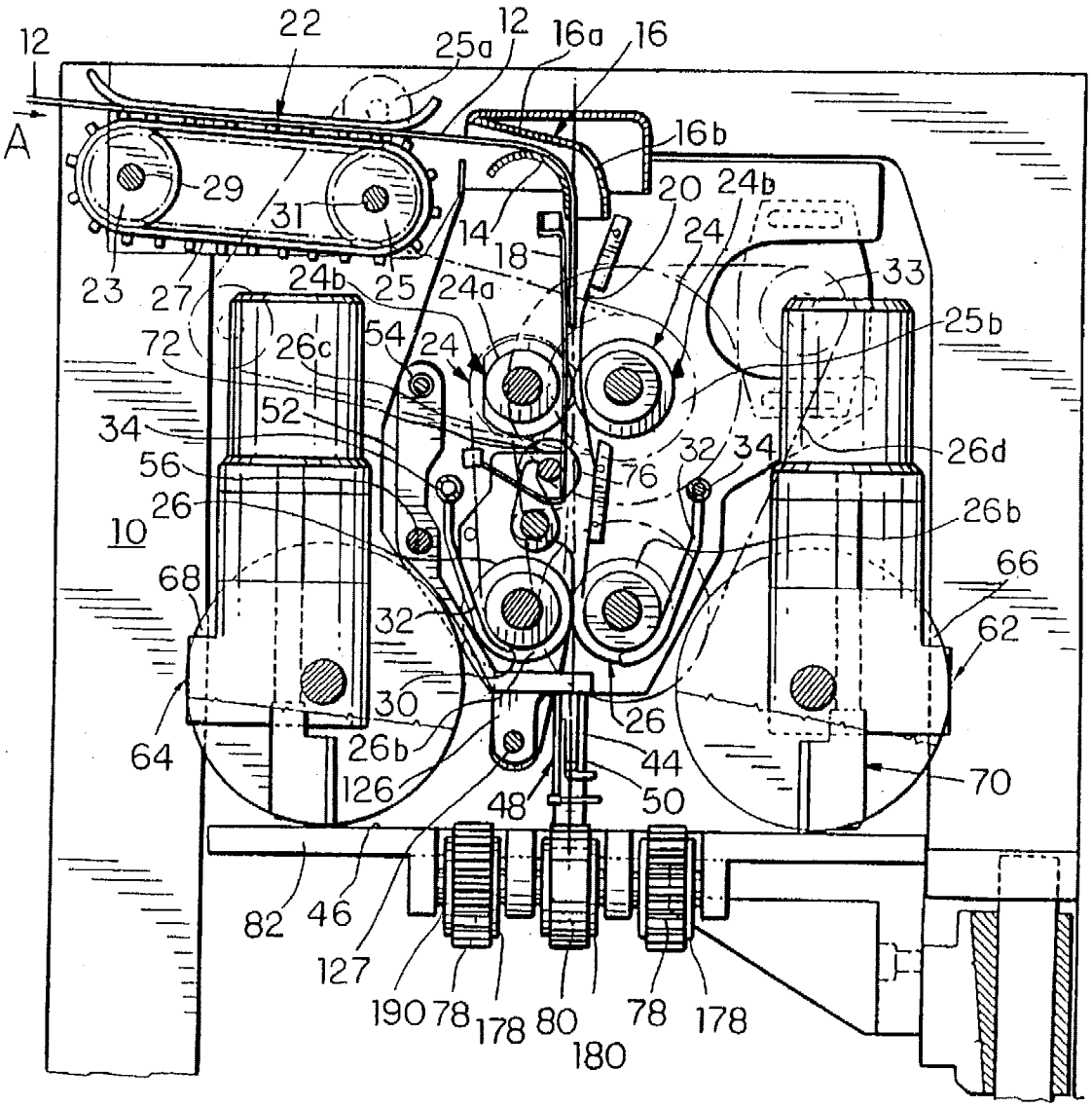

In this way, roller 26 can be displaced between the two positions corresponding to its resting position and to its operative position as above-mentioned and represented in the FIGS. 2 and 2*a*. With particular reference to the FIGS. 5, 6 and 7 the resting position (with the rollers 26 spaced from each other as shown in FIG. 5) is taken when the planar bevelled portion 24*a* is facing the plane of the band 12 (FIG. 5) as above stated, whereas the operative condition (with friction contact of the rollers 26 with the band 12) is taken when the rollers 24 are driven into rotation so that their curved surface portions come into friction contact with the band 12 (FIGS. 6 and 7). In the above mentioned operating condition the band 12 has one prepunched line P thereof located in an intermediate position (FIG. 6) between the two pairs of upper and lower rollers 24, 26, respectively. The rollers of each pair rotate in opposite directions with respect to each other as indicated by the arrows M and N of FIG. 6 and their rotation direction is thus such that a pulling action is applied to a portion of the band which is located and positioned between the aforesaid rollers to effect the tearing of the portion along its prepunched cross line P.

The tearing phase is illustrated in FIG. 7.

The displacement of the movable roller 26 can be effected, for example, through a friction control unit adapted to rotate the arms 126 so as to bring the rollers 26 into contact with the band 12.

When the friction unit or clutch is disengaged, the arms 126 are returned to the initial position by elastic means.

According to a further feature of the apparatus according to the present invention, and with particular reference to FIG. 2 and to the FIGS. 5 to 7, between the upper rollers 24 and the lower rollers 26 pressing means are provided, indicated as a whole by the reference number 72, which are also capable of taking a resting position in which the pressing means 12 is separated or disengaged from the band 12, and of being brought to an operating position in which the pressing means is engaged with the band. Such a movement according to the invention takes place synchronously with that of the rollers 24 and 26 from the resting condition to the operating one. More particularly the displacement of the pressing means 72, in the embodiment under consideration, takes place since they are associated to the lower displaceable roller 26.

More precisely the said pressing means 72 are essentially formed by a shaft 74, supported by the arms 126, to the said shaft 74 and a number of small rollers (76) being mounted, these small rollers (76) being idle and prevented, in a whatsoever known manner, from longitudinally sliding along the shaft 74.

As particularly seen from FIG. 6, when the small rollers 76 are brought into engagement with the band 12, the band 12 takes on a deformed shape and shown as curved in full outline and band 12 is moved from the outline represented by a dashed outline line in the above mentioned figure owing to a pulling action applied by the pressing means 72 thereagainst and moves the band 12 from the FIG. 5 position and as shown in dashed outline in the FIG. 6 position. Preferably the small rollers 76 are brought into engagement with the prepunched line P of the band 12. In this manner, as a result of the aforenoted pressure action and engagement with the are at the prepunched line P, said pressing means 72 are capable of absorbing most of the strains to which the band 12 is subjected during the tearing phase.

That is particularly advantageous since these strains are rather relevant and might be transmitted to the tractors 22, since the possibility exists that, during the tearing, the band 12 is abruptly slipped forwardly despite the frictional engagement with the rollers 24, whereby the operation of the tractors 22 might be affected.

With particular reference to FIGS. 1 and 2. an essentially vertical bar 44 serves as the side abutment for the sheet package, not shown, which shall be formed onto the horizontal receiving plane 46, the abutment being indicated as a whole by the reference number 48. The function of the abutment 48 is that of keeping vertically aligned the stacked sheets, the side edge of which is engaged with the abutment. In the embodiment under consideration in this description the abutment 48 is like that which is the subject—of the European Patent Application No. 91200830.7, in the name of the same Applicant to which reference is made for the understanding of the structure of the abutment 48. This structure is also disclosed in U.S. Pat. No. 5,292,223. For the purposes of explanation, it should be noted that the subject matter of European Patent Application No. 91200830.7 published under publication number 0 454 206 A3 is concerned with a device for aligning a continuous sheet strip folded along a separation or folding line and stacked in a stacker for forming a package, and includes a horizontal plane movable in a vertical direction and discloses a first lateral locator arranged on a side of a plane, fixed in a lateral direction and movable in a vertical direction and includes a second lateral locator arranged on the opposite side of the plane and is movable in both a transverse and a vertical direction. Each locator comprises at least a rectilinear vertical rod formed by at least two telescopically arranged sections.

The second locator may comprise a device for the movement in a transverse direction and a sensor for stopping the locator in a given location.

This European patent application No. 91200830.7 includes an aligning device for a continuous strip of folded sheets, stacked in a stacker for forming a package, and includes a stacking horizontal plane movable in a vertical direction, a first lateral locator arranged at a first side of the plane, fixed in the transverse direction and movable in vertical direction and a second lateral locator arranged at a second and opposite side of said plane and movable in both transversal and vertical directions, and includes means for transversally moving the second lateral locator in an area over the stacker and substantially not protruding therefrom.

The reference numerals used will not be the same as those used in the aforenoted European patent application, but will be those used in connection with this application where appropriate, and the entire text will not be added, just the portion considered to be appropriate in order to enhance the present disclosure.

Reference is made to FIG. 14, device 110 has a stacking plane 112 consisting of a plurality of metallic rods arranged in parallel. Stacking plane 112 is movable in the direction indicated by the arrows F and is actuated by a stepping motor (not depicted) driven by the printer. At a side of the stacking plane 112, a fixed frame 117 is arranged sustaining a first lateral locator 120, which is fixed in a transverse direction with respect to the stacking plane and is movable with respect to a vertical direction indicated by the arrows $F_1$.

At the opposite side of the stacking plane, there is arranged a second fixed frame 140 sustaining a second lateral locator 150. Such a locator is movable both in the vertical direction indicated by the arrows $F_2$, and in the transverse direction indicated by the arrows $F_3$.

As depicted in FIG. 14, both the locators 120 and 150 consist of straight rods formed by two pairs of coaxial cylinders 154, 152 and 164, 162 able to slide the one into the other one (usually called telescopic cylinders).

A reciprocal sliding length is determined by the length of a window 158 in the wall of the radially most external cylinder 152 from which protrudes a pin 156 connected to the radially most internal cylinder 154.

While the two locators 120, 150 are depicted as two telescopic cylinders, actually they can have different geometrical shapes, so that the upper portions 154, 164 of the rods can have an elliptical, a squared, a hexagonal or other shape preferably coinciding with the shape of the internal member of the lower portions 152, 162.

The external shape of the lower portions 152, 162 can also be different from a circular shaped profile, what matters is a convex profile (possibly also provided with edges) facing to the stacking plane 112.

In such a way, the sheet delivered by the printer has a "point shaped" contact with the surfaces of the two locators 120, 150, against a "linear shaped" contact happening in the case of a planar external profile of the lower portions 152, 162.

It will be noticed that the convex point shaped contact profile provides the minimum contact between sheet and lateral locators with a great advantage in terms of mutual sliding.

The frame 140 also supports a worm screw 128, moved by motor means 138 comprising an electric motor 142, by means of a belt 136. The work screw 128 is connected to the movable carriage 143 driven by a pair of rods 130.

On the carriage 143 is mounted an arm 145 extending in a traverse direction with respect to stacking plane 112.

At the end 147 of the arm 145 the upper portion 154 of the locator 150 is fastened. The motor 142 is actuated by the printer and should it rotate in a first direction the worm screw 128 drives the carriage 143, with the arm 145 and then the locator 150 in the transversal direction $F_3$ to the stacking plane 112; should the motor 142 rotate in a second contrary direction, the carriage 143, the arm 145 and the locator 150 are moved in transversal opposed direction $F_3$, moving them away from the stacking plane 112.

The lateral locator 150 is provided at its lower end 153 with a sensor 160, which by contacting the sheet package 114, stops the motor 142 and sets the second lateral locator 150 in a determined location.

For the sake of clarity, it should be noted that the first lateral locator 120 is fixed in a transverse direction and is not provided with similar devices for shifting in such a direction.

Depicting the operation of the device 110, in a starting step, when the printer begins to operate, the lower ends of the lateral locators 120, 150 abut on the stacking plane 112.

When the sensor 160 contacts the lateral edges of the first sheets just stacked as a package on the plane 112, it stops the motor 142, locking the position of the lateral locator 150.

The folded sheet strip is continuously delivered by the printer to the stacking plane 112 and the lateral edges thereof are driven through pointlike contacts by the convex profiles of the locators 120, 150 gradually forming an unstaggered, well squared and compact package.

When the operation of the printer is ended, the sheet package 114 is moved away and the device is returned to the slanting position, completely clearing the stacking plane to possibly receive other sheet formats to which the device will be automatically adapted.

While in the preceding disclosure, there has been provided a stepping motor for gradually lowering the stacking plane 112, in simpler devices the plane can be fixedly mounted at a proper distance from the printer output.

Referring to FIG. 15 which is derived from European patent application no. 91200830.7 and similarly with respect to FIG. 14, the device 110 is provided with a stacking plane 112, consisting of a plurality of metallic rods each other parallel arranged, the plane stacking the folded sheets delivered by the "laser" printer (not shown) are arranged over the device 10 and forming a package 114. The stacking plane 112 is movable in a vertical direction indicated by arrows F and is driven by a stepping motor (not shown) controlled by the printer itself. Along a first side of the stacking plane 112 is arranged a first fixed wall 116, delimitating the package on that side, supporting a bracket 118 for a first lateral locator 120 fixed in a transverse direction and movable in vertical direction indicated, for example, by arrows F1.

Between a threaded shaft 128 and a smooth bar 30, there is arranged a yoke 144 comprising a first bushing 146 provided with threaded bore adapted to the threaded shaft 128 and a second bushing 148 provided with a smooth bore strictly fitted to the smooth rod 30, the yoke 144 is a support for the second lateral locator 150, movable both transversally and vertically, formed by a lower cylindrical body or cylinder 152 bearing coaxially fitted an upper cylindrical body or cylinder 154, in turn mounted to the yoke 144. The lower cylinder 152 is movable with respect to the upper cylinder 154, but limited in the movement by a pin 156 fastened to the upper cylinder and slidable within a slot 158 cut in the lower cylinder 152, the assembly of the pin 156 and slot 158 allowing a movement of the lower cylinder 152 of the locator 150 according to the to the arrows F2. The lower cylinder 152 itself is provided at the lower end with a sensor 160 sensing or detecting the contact of the locator 150 against the package 114.

Similarly, the opposed locator 120 is formed by a lower cylinder 162 bearing fitted an upper cylinder 164 also provided with a pin 166 limiting the movement of the lower cylinder 162 exactly in the same way of the pin 156.

As the locator 150 is connected to the yoke 144 moved by the means 38 through the threaded rotating shaft 128, to every turn of the electric motor 142 of the means 38 corresponds a transversal movement of the locator 150 in the direction indicated by the arrows $F_3$ which, of course, according to a first rotating direction of the motor 142 will be in a first direction and according to an opposed rotating direction will be in the opposed direction, in accordance with what is already known and depicted in FIG. 14.

The operation of the device 110, which is very similar to the device depicted in FIG. 14, is as follows:

when the printer begins to operate, the stacking plane 112 is in the upmost position and the yoke 144 is in the position nearest to the second fixed wall 122; the lowest ends of the lateral locators 120 and 150 will abut against the stacking plane 112. The continuous strip of "accordion" folded sheets along separating or folding lines is delivered by the printer and is driven to the plane 112, so that the lateral edge of the sheets or strip lightly touches the first lateral locator 120. Thus the first sheets are stacked on the plane 112 for beginning the formation of the package 114.

The printer actuates the stepping motor (not shown) by gradually lowering the plane 112 and the plane 112 is accompanied by the lower telescopic portions, consisting of the lower cylinders 152 and 162, of the respective locators 150 and 120, by descending from the upper cylinders and 164 for what allows the length of the slot 158.

The printer actuates also the motor 142 which through the belt 136, the pulley 134 and the threaded shaft 128 advances the yoke 144, the lateral locator 150 and the sensor 160 to the plane 112.

The contact of the sensor 160 with the lateral edges of the first sheets stops the motor 142, by locking the position of the lateral locator 150, so obtaining all the advantages of a right and well squared package already obtained by the embodiment depicted in FIG. 14 and, in addition, the advantage that, being all the mechanism, comprised of the threaded shaft 128, the yoke 144 and the adjacent hardware, contained in the space between the first fixed wall 116 and the second fixed wall 122, it happens that the total external dimensions of the device 110 is independent from the size of the sheets forming the package 114, because the threaded shaft 128, which can be as long as the whole distance between the two walls 116 and 122, allows to accommodate a large multiplicity of package size by simply moving the yoke 144 and the locator 150 therewith.

For sake of completeness only it is herein recalled that the abutment 48 and, more particularly, the cylindrical body 50 in which the bar 44 is housed, is vertically movable with respect to the said bar and cross-wise together therewith. The latter movement is particularly permitted thanks to the connection between the bar 44 and the related supporting means consisting of a L-shaped bracket indicated as a whole by the reference number 52, which is displaceable along a rotatable threaded shaft 54 and along a fixed smooth bar 56.

Like abutment means, herein not represented, are provided at the opposite side of the sheets to be stacked, apart from the fact that the latter, contrary to the preceeding one, is fixed in the cross-wise direction and displaceable in the vertical direction as described in the above mentioned U.S. patent as well as the aforenoted European Patent application In order to direct the sheets to be stacked onto the plane 46, after the tearing separation when a continuous and cross-wise prepunched paper band is fed to the apparatus, nozzles 30 are provided connected through a shaped duct 32 to a header 34 for the compressed air supply, said header being in turn connected, under the control of a controllable a programmable check valve, to a source of air under pressure.

Both the check valve and the air pressure source are not represented and are of standard type.

Of course along the header 34 a number of shaped ducts 32 is provided, seated in the grooves **26*b* or in separation spaces dividing the single cylinders forming each roller 26**.

It is to be observed that, a header like header 32 not shown in FIG. 2 for sake of clarity of the drawing, a like header is symmetrically provided, as well as the shaped ducts 32 and the nozzles 30, whereby against the paper sheet coming out of the guide hollow space defined by the strips or strips 18 and 20 a number of air blows impinges from either side dependent on the actuation and thus on the programming of the check valves. As a consequence the foreedge of the paper sheet is tangentially bent owing to the action of the number of air blows and the sheet is laid down onto the plane 46 with the desired laying and orientation.

As a matter of fact, especially when a tearing separation is effected before the laying down and the collecting onto the plane 46, the air pressure blows coming out of the nozzles 30 fulfill a double function.

Firstly, when the tearing separation is carried out, the nozzles 30 cooperate so as to enhance the complete coming out of the sheet below the prepunched line along which the tearing separation has been carried out. A second actuation of these nozzles, immediately after the first one, is used to direct the first incoming sheet so as to lay down the first incoming sheet onto the plane 46 with the desired laying.

Figure 4:
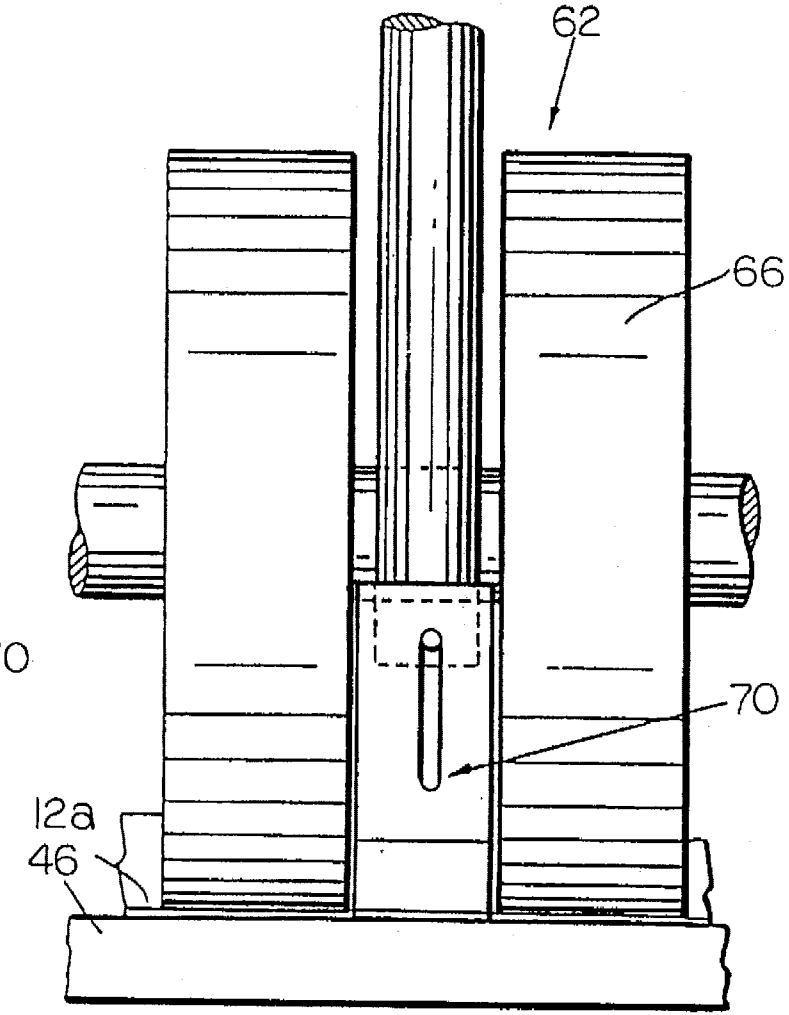
FIG. 4 is a partial view according to the direction of the arrow IV of FIG. 1 of the aforesaid station.
Figure 3:
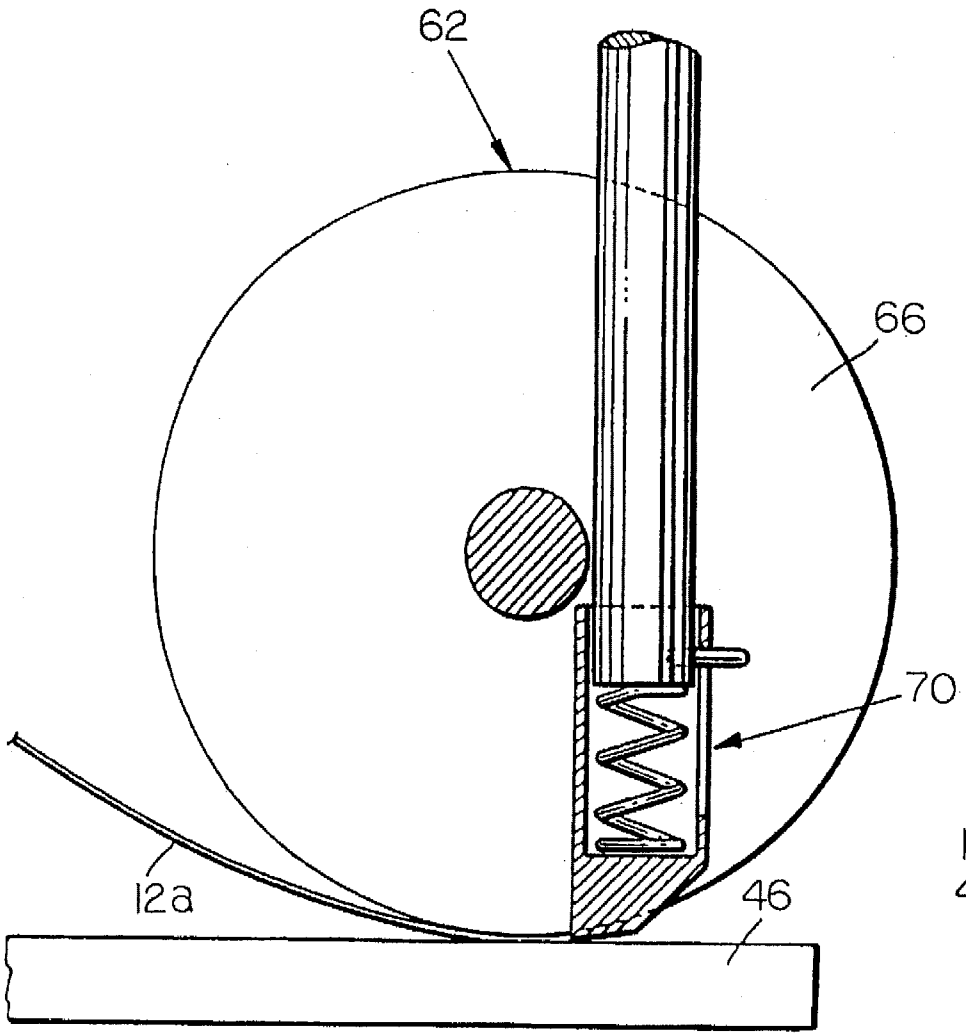
FIG. 3 is a schematic view according to the lines III—III of FIG. 1 of one of the side stopping stations at the beginning of the forming of the sheet package.

The above-mentioned stopping and/or folding stations are schematically illustrated in FIGS. 1 and 2, and part thereof is schematically represented in an enlarged scale in the FIGS. 3 and 4. Of these stations, that of the right side looking at the FIGS. 1 and 2, is indicated as a whole by the reference numeral 62, whereas that of the left side in the same figures is indicated on the whole by 64.

The above said stations essentially comprise a grooved roller 66, 68 (FIGS. 1 and 2) rotating in the opposite direction with respect to the other one and which, in the case of processing of a continuous band 12 does also carry out the folding of the band portion with which it is engaged, whereas in the case in which separate sheets are processed keeps the foreedge of said sheets against the collecting plane 46. The stopping means of the aforesaid stations consist of retractable appendices 70, only one of which is represented in FIG. 1 for sake of representation clarity, against which the band or sheet to be stacked is stopped. The lower end of the retractable appendices 70 is always maintained in contact with the collecting or stacking plane 46 as the latter is lowered with the increased height of the sheet package being formed thereonto.

Figure 12:
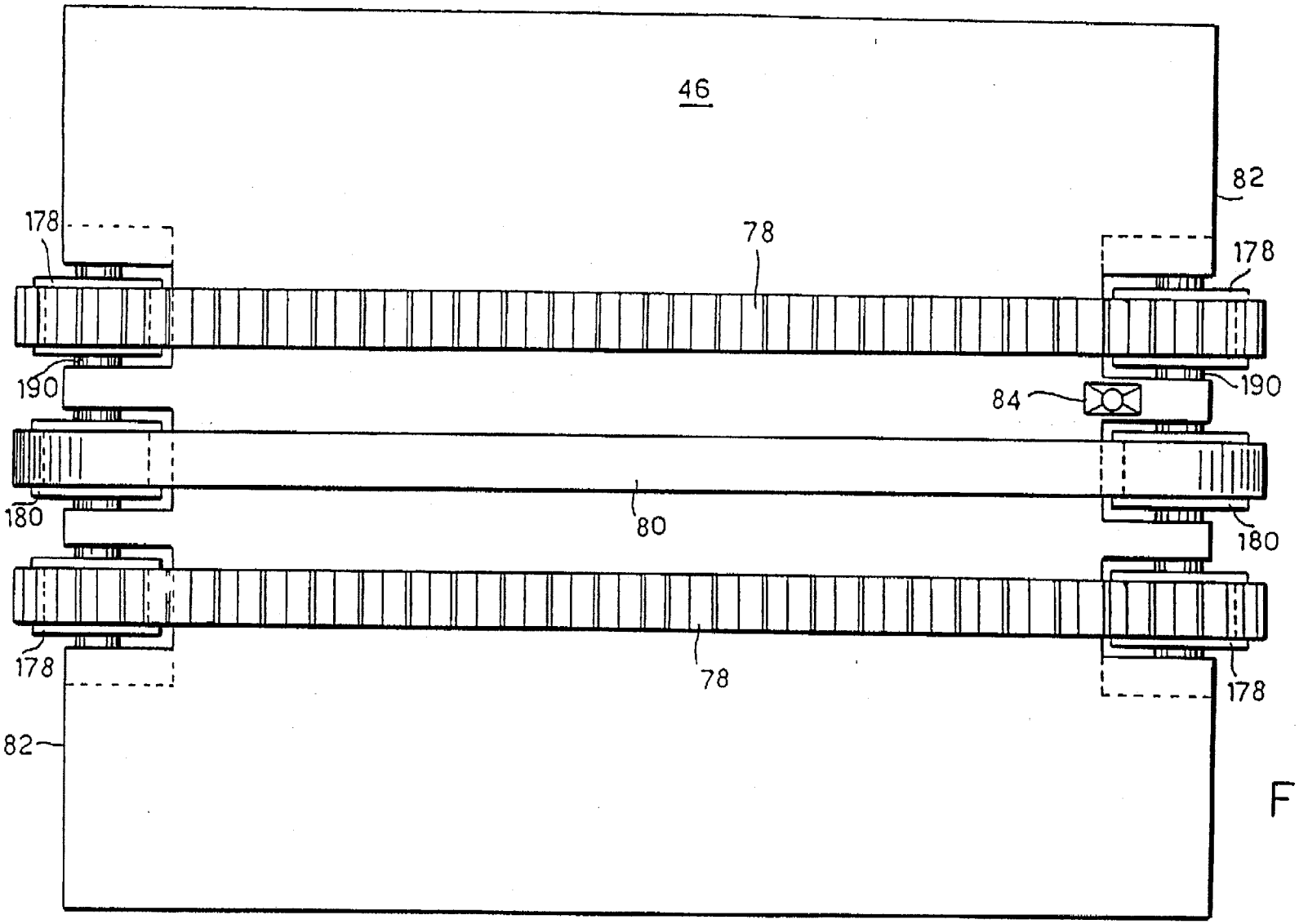
FIG. 12 is a plan view detailedly showing the sheet stacking plane.
Figure 13:
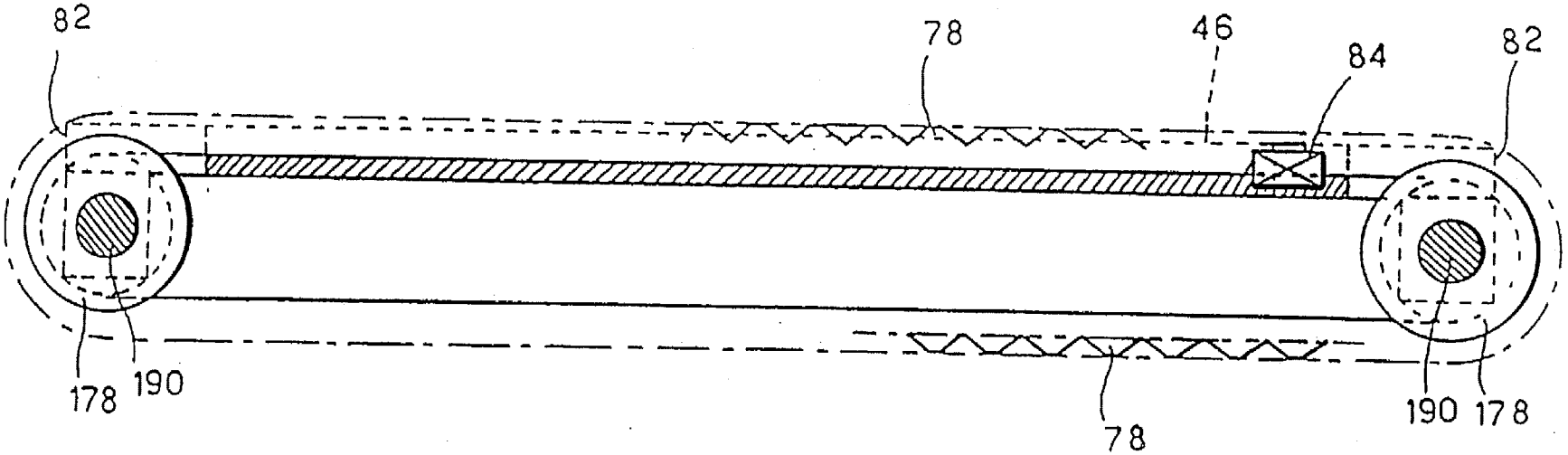
FIG. 13 is a side view of the aforesaid stacking plane.

Referring now particularly to the FIGS. 12 and 13 the stacking plane 46 shall be detailedly described which, starting from a raised position at the beginning of the forming of the form package, is gradually lowered in a known manner (not shown) as the sheet package is formed.

Said plane 46 is provided according to the invention with means for the ejection of the completed sheet package from the apparatus. The ejection can be effected by firstly sending a stopping signal to the plane lowering means as well as a substantially simultaneous signal for the actuation of the ejecting means. This operation can be effected when the consistency of the sheet package is believed adequate, whereas the signals can be emitted under the control of suitable programming means, per se known and not represented.

The ejecting means comprise three belts, two side belts 78 and a center belt 80 essentially parallel to each other and extending cross-wise with respect to the stacking plane 46 and thus to the direction according to which the forms are laid down onto the plane 46.

In the embodiment under consideration, the two side belts 78 of the three belts are toothed in order to ensure a contact without slipping with the sheet package, whereas the central one 80 is devoid of teeth.

The belts 78 and 80 are particularly of the endless type and encompass the plane 46. Their motion is ensured by being engaged with pulleys 178, 180, (which pulleys 178 are toothed for the belts 78 and pulley 180 is not toothed for the belt 80), said pulleys 178, 180 being keyed onto a shaft 190 seated in a cavity formed on the two opposite sides 82 of the plane 46 and are freely rotatable. The rotation of the shaft 190 is obtained by connecting said shaft to motor means not shown and under the control of the above mentioned programming means. The stacking plane 46 is lastly provided with sensing means for the detection of the presence of the sheet package which, in the considered embodiment, as shown particularly in the FIGS. 12 and 13 consists of an electrical photocell 84 located on the upper surface of the plane 46 at the edge 82 through which the sheet package is ejected. The apparatus is operated, thus stacking the sheets one onto another, until the cell 84 is covered by the sheet package. Upon the package has reached the desired consistency, the apparatus is stopped and the package is ejected as more particularly explained hereinabove, particularly by the advancing motion of the belts 78, 80. If the package is correctly ejected, i.e. it comes completely out of the apparatus, the cell 84 is uncovered and a novel operation cycle of the apparatus is started.

In the case that the package does not come completely out of the apparatus, the cell 84 remains covered and the apparatus is not started again, lacking the necessary activating signal to its operating members. The attendant is then allowed to manually take out the sheet package, whereby the cell 84 becomes uncovered and the apparatus is permitted to start its operation again.

The operation of the apparatus according to the invention, apart from that of the tearing separation device already shortly described hereinabove, is the following one:

The band 12 is fed to the apparatus and advanced by the tractors 22. Upon having been deviated downwardly by the profiles 14, 16, the band 12 advances to the tearing means 24, 26, which can be either operated or not. The position of the abutment 48 has been preliminary adjusted as a function of the width of the band 12.

In this advancement phase the aforesaid band is guided by the strips 18, 20 passing through the grooves of the rollers 24, 26. If the tearing separation device 24, 26 has been operated, when the foreedge 12*a* of the sheet starts protruding in a substantial measure below the tearing separation device the compressed air blows are actuated being emitted through the nozzles 30 (of course from the suitable side to oblige the paper sheet to be bent towards the desired side).

The emission of an instantaneous blow or for a very shod time, since the continuing advancement downwardly of the sheet causes the sheet to take the desired laying i.e. since the edge has taken a loop shape of a length such that, the advancement speed of the sheet being the same, it is permitted to reach the stopping station 62. At that point, as already stated, the blow emission is ceased whereby the sheet can be laid down by gravity and owing to its intrinsic elasticity it takes the desired position onto the collecting plane 46.

This operation is cyclically repeated for each subsequent sheet until the desired number of sheets is stacked.

Of course the sequence of the several operating phases shall be controlled and adjusted by means of suitable programming means, per se known and thus not represented.

The advantages which can be obtained with the apparatus of the present invention are evident from the above description and the main one have been already recalled hereinabove.

Variations and modifications conceptually equivalent can be made in the apparatus of the invention without departing from the scope thereof.

I claim:

1. Apparatus for high speed cutting and stacking of resilient materials formed from a plurality of definitive sheets, adjacent sheets being separated by a transverse prepunched cross line, comprising:

frame means and stacking plane means proximate to said frame means;

dragging means coupled with said frame means at an inlet end of said frame means for moving said resilient materials in a direction through said apparatus from said inlet end towards said stacking plane means;

guide means associated with said dragging means for guiding said resilient materials towards said stacking plane means;

tear separation means actuatable to effect a tear separation of each of said definitive sheets of said resilient materials along the transverse prepunched line between adjacent definitive sheets extending from one edge of each of the definitive sheets to another edge of the definitive sheets;

said tear separation means comprising one pair of upper and one pair of lower rollers adapted to get into friction contact with the definitive sheets, one roller of said pair of upper rollers being provided with at least a planar bevelled portion and each said lower rollers being essentially cylindrical, at least one of said lower rollers being permanently driven into rotation with a peripheral speed higher than that of said upper rollers;

said upper rollers having an upper rollers rest condition and an upper rollers operating condition, and said lower rollers having a lower rollers rest condition and a lower rollers operating condition;

said lower rollers being spaced from each other in said lower rollers rest condition when said planer bevelled portion of said one upper roller is parallely positioned in front of a plane of the connected sheets in said upper rollers rest condition, and aid lower rollers being brought into a friction contact condition with the definitive sheets in said lower rollers operating condition, when said upper rollers are driven into rotation and brought into friction contact with the definitive sheets in said upper rollers operating condition with one of the transverse prepunched cross lines, between said upper and said lower rollers;

pressing means positionable in a pressing means rest position spaced from the definitive sheets when said upper rollers are in said upper rollers rest condition and said lower rollers are in the lower rollers rest condition, said pressing means being positionable in pressing means operating position in contact with said definitive sheets in which said upper rollers are brought into engagement with said definitive sheets and said lower rollers are brought into engagement with the definitive sheets during a tearing phase of the definitive sheets when said upper rollers are in said rollers operating condition and said lower rollers are in said lower rollers operating condition;

said pressing means comprising at least a small roller mounted in a freely rotatable manner on a supporting shaft provided on supporting means connected to said frame means so as to permit a displacement thereof from the pressing means rest position to the pressing means operating position and vice versa;

control means for displacement of said supporting shaft associated with said supporting means, and said supporting shaft being supported by supporting arms pivotally connected to said frame means;

sensing means associated with said stacking plane means for detecting the presence of the definitive sheets and a sheet package formed from the definitive sheets on said stacking plane means; and ejecting means associated with said sheet stacking plane means for ejecting the definitive sheets forming the sheet package.

2. Apparatus according to claim 1, wherein said small roller has at least a convex portion adapted to be engaged with the definitive sheets in the pressing means operating position.

3. Apparatus according to claim 2, wherein said convex portion is brought into engagement with said transverse prepunched cross line.

4. Apparatus according to claim 1, wherein one lower roller of said pair of lower rollers is supported in a freely rotatable manner by said supporting means connected to said frame means so as to permit the displacement thereof from the lower rollers rest condition to the lower rollers operating condition and vice versa.

5. Apparatus according to claim 4, wherein said frame means includes a fixed framework, and the other lower roller of said pair of lower rollers is supported by an arm pivotally connected to said fixed framework.

6. Apparatus according to claim 1 wherein said supporting arms are connected with one of said lower rollers for supporting one of said pair of lower rollers.

7. Apparatus according to claim 4, wherein said control means is a clutch means.

8. Apparatus according to claim 1, in which said definitive sheets are formed in an accordion-like folded material of a continuous band; and including diverting means cooperating with air pressure means for emitting an air blow directed to a plane of the sheets forming said continuous band exiting from said guide means.

9. Apparatus according to claim 1, wherein said ejecting means comprises at least one pair of motor driven belts encompassing said stacking plane means and positioned according to a direction substantially orthogonal to a direction according to which said definitive sheets are laid down onto said stacking plane means.

10. Apparatus according to claim 9, wherein said motor driven belts are toothed.

11. Apparatus according to claim 1, wherein said stacking plane means is a stacking plane and said sensing means for the definitive sheets is located at an edge of the stacking plane means from which said sheet package is ejected.

12. Apparatus according to claim 11, wherein said sensing means comprises at least a photocell positioned on a surface of said stacking plane means onto which the sheet package is formed from said definitive sheets, said sensing means being capable of revealing the presence of a portion of the sheet package thereabove.

13. Apparatus for high speed stacking of individual paper sheets forming part of a continuous paper band of connected sheets by superimposing said individual paper sheets one onto another to form a sheet package, comprising:

dragging means associated with frame means for dragging the continuous band of connected paper sheets to at least one of a first and a second stopping stations and to diverting means for guiding two separate sheets after passing a separation station in a direction to a sheet stacking plane proximate to said frame means;

band guide means positioned between a band inlet area to the apparatus and said diverting means, said band guide means being means associated with tearing separation means of a tearing separation station actuatable for carrying out a tearing separation of the individual paper sheets of the continuous paper band of connected sheets along a prepunched cross line thereof, comprising one pair of upper rollers and one pair of lower rollers adapted to get into friction contact with the connected paper sheets, said diverting means comprising nozzle means connected to an air pressure source, said nozzle means being suitable for emitting an air blow essentially orthogonally directed with respect to a plane of a paper sheet of the continuous band of connected sheets exiting from said band guide means and spaced from said tearing separation station;

one roller of said pair of upper rollers being provided with at least a planar bevelled portion and both rollers of said pair of lower rollers being essentially cylindrical, at least one roller of said pair of lower rollers being permanently driven into rotation with a peripheral speed higher than that of said pair of upper rollers;

each roller of said pair lower rollers being spaced from each other to form a pair of lower rollers rest condition when said bevelled portion of said one upper roller is parallely positioned in front of a plane of a facing surface of the continuous band of connected forming a pair of upper rollers rest condition and said pair of lower rollers being brought into a lower rollers operating condition with the continuous band of connected sheets being in frictional engagement with said pair of lower rollers, and said pair of upper rollers being driven into rotation and brought into an upper rollers operating condition with friction contact with the continuous paper band of connected sheets, said band positioned between said pair of upper rollers and said pair of lower rollers, pressing means operably associated with said lower rollers positionable in a pressing means rest position spaced from the continuous paper band of connected sheets when said upper rollers and said lower rollers are in the pair of upper rollers rest condition and the pair of lower rollers rest condition, respectively, and brought to a pressing means operating position in contact with said band and in synchronism with said upper and said lower rollers being brought into engagement with the continuous paper band of individual connected sheets therebetween during a tearing phase when said lower rollers are in the said lower rollers operating condition and said upper rollers are in said upper rollers operating condition;

sensing means associated with said sheet stacking plane for detecting the presence of a sheet package formed by individual sheets superimposed one onto the other on said sheet stacking plane; and ejecting means associated with said sheet stacking plane for ejecting the sheet package.

14. Apparatus according to claim 13, wherein one lower roller of said pair of lower rollers is supported in a freely rotatable manner by supporting means connected to said frame means so as to permit a displacement thereof from the pair of lower rollers rest condition to the pair of lower rollers operating condition and vice versa, and control means for displacement of said pair of lower rollers from the continuous paper band associated with said supporting means.

15. Apparatus according to claim 14, wherein said frame means includes a fixed framework and said other lower roller of said pair of lower rollers being supported at opposite ends by arms pivotally connected to said fixed framework for coordinating the other lower roller with said pressing means.

16. Apparatus according to claim 14, wherein said control means include a clutch means.

17. Apparatus according to claim 13, wherein the ejecting means for ejecting the sheet package from the sheet stacking plane comprises at least one pair of motor driven belts encompassing said sheet stacking plane and positioned according to a direction substantially orthogonal to a direction according to which said sheets are laid down onto said sheet stacking plane.

18. Apparatus according to claim 16, wherein said motor driven belts are toothed.

19. Apparatus according to claim 13, wherein said sensing means is located at an edge of said sheet stacking plane from which the sheet package is ejected, and said sensing means comprises at least a photocell positioned on a surface of sheet stacking plane onto which the sheet package is formed, said sensing means being capable of revealing the presence of a portion of the sheet package thereabove.

* * * * *